United States Patent [19]

Ohara et al.

[11] Patent Number: 4,570,700

[45] Date of Patent: Feb. 18, 1986

[54] FLAT, MULTI-LUMINAL TUBE FOR CROSS-FLOW-TYPE INDIRECT HEAT EXCHANGER, HAVING GREATER OUTER WALL THICKNESS TOWARDS SIDE EXTERNALLY SUBJECT TO CORROSIVE INLET GAS SUCH AS WET, SALTY AIR

[75] Inventors: Toshio Ohara; Sigenobu Fukumi, both of Kariya; Yoshiyuki Yamauchi, Aichi, all of Japan

[73] Assignee: Nippondenso Co., Ltd., Kariya, Japan

[21] Appl. No.: 560,977

[22] Filed: Dec. 13, 1983

[30] Foreign Application Priority Data

Jan. 10, 1983 [JP] Japan ..... 58-2511

[51] Int. Cl.[4] ..... F28F 1/02

[52] U.S. Cl. ..... 165/134.1; 165/170; 165/177; 165/906

[58] Field of Search ..... 165/134, 146, 147, 170, 165/172, 177, DIG. 9, DIG. 13

[56] References Cited

U.S. PATENT DOCUMENTS

| | | | |
|---|---|---|---|
| 527,680 | 10/1894 | Gilchrist | 165/177 |
| 1,786,337 | 12/1930 | Dargent | 165/134 |
| 2,055,549 | 9/1936 | Modine | 165/146 |
| 3,239,002 | 3/1966 | Young | 165/134 |
| 4,030,539 | 6/1977 | Stute et al. | 165/134 |
| 4,475,586 | 10/1984 | Grieb et al. | 165/134 R |

FOREIGN PATENT DOCUMENTS

| | | | |
|---|---|---|---|
| 116555 | 10/1978 | Japan | 165/134 |

*Primary Examiner*—Sheldon J. Richter

*Attorney, Agent, or Firm*—Cushman, Darby & Cushman

[57] ABSTRACT

A transversally corrugated multi-luminal flat tube for circulating the refrigerant of an evaporator for an automotive air conditioner in indirect heat exchange relation with air is provided with one laterally marginal portion, being the one which faces inlet air flow in a transverse cross-flow system, that is so thick-walled about its outer perimeter, that inlet air, which is corrosive because it contains moisture and salt, will be prevented for a sufficiently long time from corroding pinholes through that part of the tube, the remaining part of the outer periphery of the flat tube, because it is less subject to corrosive attack being thinner walled, so as to maximize durability and mass flow rate, while minimizing weight and cost.

20 Claims, 11 Drawing Figures

FIG. 1
PRIOR ART
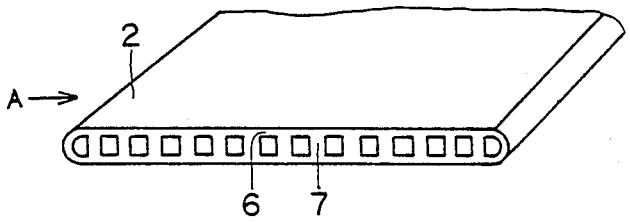
FIG. 2A
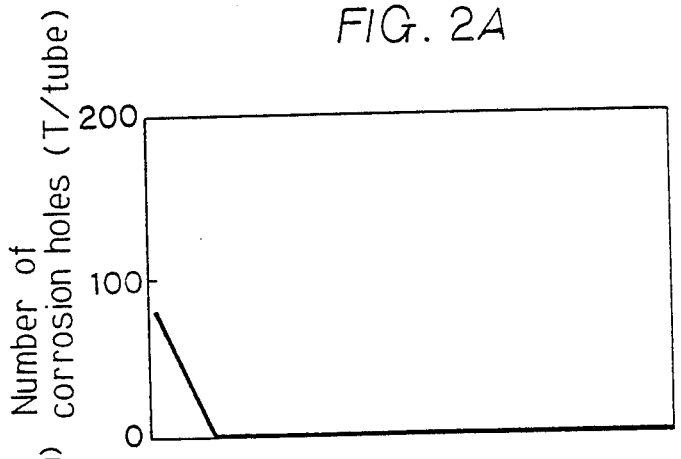
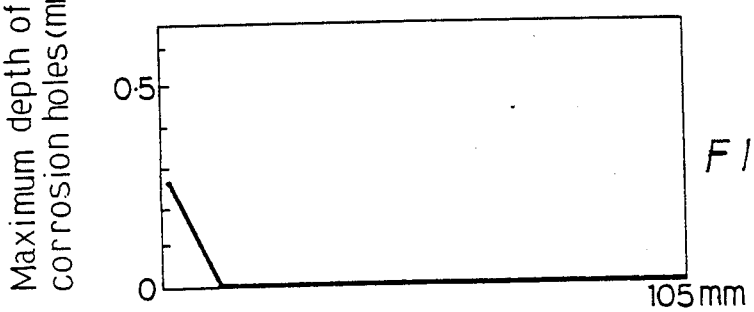
FIG. 2B
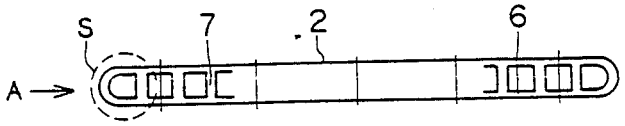
FIG. 2C

FLAT, MULTI-LUMINAL TUBE FOR CROSS-FLOW-TYPE INDIRECT HEAT EXCHANGER, HAVING GREATER OUTER WALL THICKNESS TOWARDS SIDE EXTERNALLY SUBJECT TO CORROSIVE INLET GAS SUCH AS WET, SALTY AIR

BACKGROUND OF THE INVENTION

The present invention relates to an improvement of a flat tube for a heat exchanger, such as in evaporator of an air conditioner for automobiles.

A conventional tube 2 of this type is, as shown in FIG. 1 comprised, of a perimetrical wall 6 and a plurality of transversally spaced inner walls 7 extending between corresponding sites on the interior of opposite broad faces of the perimetrical wall 6. In order to reduce the weight of the tube 2 and improve its performance by reducing the pressure loss in the tube, it is necessary to thin the walls 6 and 7, increasing the cross-sectional areas of the passages formed therein. It is relatively easy to thin the inner walls 7 since these need only to need the standards for pressure resistance. Therefore the thinning of inner walls has been encouraged in the past. However as to the perimetrical wall 6 it was difficult to thin the same, since in addition to meeting pressure requirements, the outer wall must possess a certain level of thickness so as to be adequately resistive for a predetermined period of time against corrosion., i.e. to the formation of pinholes made through the tube by corrosion. Corrosion of the type above explained occurs with particular intensity in regions where the environment includes high humidity and salty air.

SUMMARY OF THE INVENTION

It is an object of the present invention to provide, especially for use in a heat exchanger a flat tube which is more resistive than the conventional ones against corrosive environments.

The main feature of the present invention is to obtain a flat tube which has thicker walls at necessary positions so that it lasts longer in severe conditions.

The flat tube of the present invention has an upstream end portion at one end of the longitudinal axis of the tube, which has a thicker tube-bounding outer perimetrical wall than does the remaining downstream portion of the tube. The upstream end portion of greater wall thickness extends from the upstream end for a sufficient distance to resist corrosion but not so far as to cause the tube to become too heavy in consideration of the tube strength required. A flat tube thus designed simultaneously meets the weight lightening requirement and the anti-corrosion requirement.

BRIEF DESCRIPTION OF THE DRAWINGS

FIG. 1 shows part of a conventional flat tube for an evaporator,

FIGS. 2A, 2B and 2C are two graphs showing corrosion test results the conventional flat tube for an evaporator and an end view of such tube.

DETAILED DESCRIPTION OF THE PREFERRED EMBODIMENTS

The inventors first considered the phenomena of corrosion and tried to analyze the mechanism of corrosion. To accomplish this purpose, the inventors conducted tests on the evaporators actually installed on vehicles. Representative results are as shown in FIGS. 2A and 2B, i.e. the graph in FIG. 2A shows that many corrosion pinholes are found in the conventional flat tube of FIGS. 1 and 2C at the air inlet end of the evaporator and they reduce sharply in prevalence as one goes to the air outlet side of the same. The graph of FIG. 2B shows that the depth of the corrosion holes is deep at the upstream inlet end of the tube and again reduces sharply as it goes to the rear downstream end of the tube. In fact, there were found no corrosion holes at the other portions than the upstream end portion which is shown at S in FIG. 2C.

FIGS. 2A and 2B relate to a test run on an evaporator mounted on a middle-sized car which was driven in Thailand. Our tests showed that the same phenomena exist in many other examples.

Embodiments of the present invention are explained with reference to FIGS. 3–9.

Figure 3:
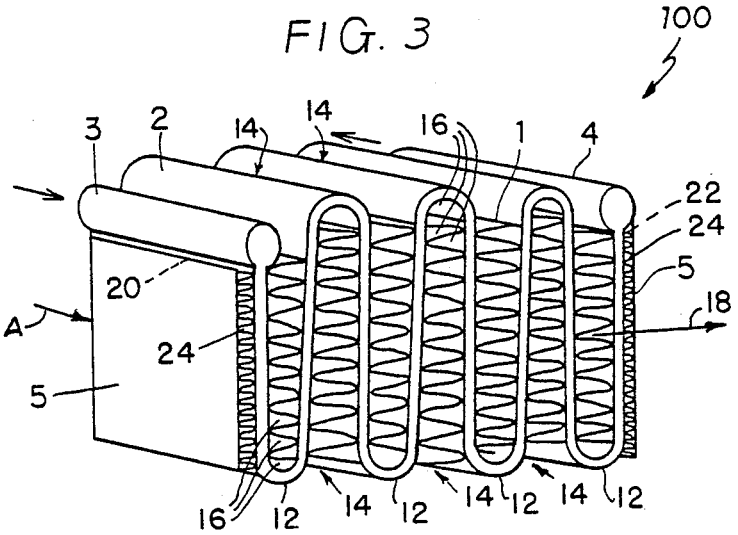
FIG. 3 shows an evaporator unit using a flat tube constructed according to principles of the present invention.

In FIG. 3, numeral 10 designates an evaporator constructed by providing a long length of flat tube 2 with a series of relatively large transverse corrugations 12 in each of the troughs 14 of which a corrugated fin 1 is provided and brazed to the outside of the flat tube 2. This provides in each trough 14 a series of air passages 16 extending transversally of the length of the flat tube 2, each such passage being open at an air inlet end (which does not show because it is at the rear FIG. 3) and an air outlet end 18. The flat tube 2 is shown including a simple series of longitudinal passageways or lumens 2A, each of which is open at an inlet end 20 and at an outlet end 22. At each end 20, 22, all the lumens open into a respective manifold or header 3, 4 which is mounted to extend transversally of the respective tube end, e.g. by being brazed to the flat tube 2. The tube 2 may be made of a high heat conductivity material such as aluminum alloy containing a small amount of manganese and copper.

As is conventional, the provision of many longitudinal passages 2A increases the efficiency of heat exchange in comparison with a similar tube having no internal longitudinally-extending divider walls 7.

Cover plates 5 may be provided at opposite ends of the evaporator unit 10 to protect the corrugated fins provided on the outermost faces 24 of the flat tube 2. Although not shown, the corrugated fins 1 may be provided with a system of louvers for increasing the efficiency of the heat exchange.

In use, an air stream is conducted through the evaporator 10 exteriorly of the heat exchanger tube 2, parallel to the transverse dimension of the tube 2, through the air passages 16 in the direction of the arrow A. (Comparable arrows A are shown in FIGS. 5–9 to help orient the reader.) At the same time that the air is flowing through the air passages 16 and out towards the foreground at 18, another fluid is being introduced into the passageways at the downstream end of the flat tube 2 through the inlet header 3, flowing along the lengths of these passageways, and out the downstream end of the flat tube 2 through the outlet manifold 4. In an evaporator of an automotive air conditioning system, typically this other fluid is the refrigerant, and the outlet manifold 4 conducts that fluid to the compressor of the conventional apparatus of a refrigeration cycle (not shown).

Figure 4:
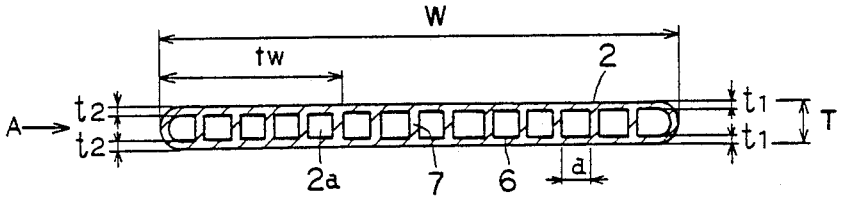
FIG. 4 shows a transverse cross-sectional view of a flat tube of a first embodiment of the present invention.

In FIG. 4, the width W of the flat tube 2 is in the general range of from 100 mm to 200 mm, and the proper width is decided in accord with the desired capacity of the evaporator where the tube 2 is used. The thickness T of the tube 2 is in the general range of from 3 mm to 10 mm, although it also changes in accord with the desired capacity of the evaporator. The width a of each lumen 2*a* in the tube 2 is usually selected from the range of from 1 mm to 10 mm. In this embodiment the width a of the lumen 2*a* is the same for every lumen.

The thickness $t_2$ of the wall 6 of the corrugated flat tube 2 is thicker throughout the distance w from the air inlet end of the heat exchanger than the thickness $t_1$ at the remaining downstream portion of the tube 2 leading to the air outlet end 18 of the heat exchanger. The distance w is wide enough to include the portion where the corrosion tends to occur, which has been determined from the test results summarized in FIGS. 2A and 2B to be throughout a width of flat tube equating to 5 mm from the air inlet end of the evaporator. The distance w on the other hand must be as narrow as possible, since the wider it is, the more it contradicts the fundamental purpose of thinning the wall 6, i.e. to lighten the total weight of the tube 2. In consideration of the above, the distance w is determined to be less than a half of the total width W, measuring from the air inlet end of the heat exchanger.

The thickness $t_2$ of the wall must be at least 0.3 mm to be enough to resist against a corrosive environment for a sufficient time. The thickness $t_2$ must not be too large either, since excessive thickening contradicts the basic weight lightening purpose and also since it makes the cross-sectional area of the longitudinal passageways 2*a* too small. In practicing the pesent invention in an automotive air conditioning system as described it is suggested that one select the thickness $t_2$ to be in the range of from 0.4 mm to 1.5 mm. The preferable range of the thickness $t_2$ is, according to the inventors' tests, from 0.6 mm to 0.8 mm.

On the other hand, the thickness $t_1$ at the air outlet end of the heat exchanger comprising of the tube 2 can be relatively thin, since there occurs substantially no corrosion there. It is usable if the thickness $t_1$ is over 0.2 mm. In order to give the tube 2 enough strength, it is recommended that one select the thickness $t_1$ to be in the range of from 0.3 mm to 1.0 mm. In accordance with inventors' experiments, the preferable range for the thickness $t_1$ is from 0.3 mm to 0.4 mm.

Next, the operation of an evaporator according to the above construction is explained. When the refrigeration cycle starts to operate, the refrigerant expanded at the pressure decreasing means to become vapor is introduced into the evaporator through the inlet pipe 3. The refrigerant flowing through the flat tube 2 conducts indirect heat exchange through the tube wall 6 and fins 1 with the air introduced by a fan and then it is discharged to the compressor via the outlet pipe 4. The air cooled down by the heat exchange is then blown out into the passenger compartment of the automobile.

The problem of corrosion of the flat tube 2 is comparatively small when the recirculated air, i.e. the air already in the automobile is introduced into the evaporator. The problem is however that the environmental air, i.e. outside the air around the automobile with moisture and salt is often introduced into the evaporator. In this latter case, moisture and salt deposit on the tube 2 with dust also in the air, which creates a circumstance where corrosion is more likely to occur and, the place which is most subject thereto is the air inlet end portion of the heat exchanger made of the tube 2.

In the present invention however, the air inlet end portion indicated by w is provided with a thicker wall thickness $t_2$, therefore there hardly occur any leaks of refrigerant through pinholes caused by corrosion.

Figure 5:
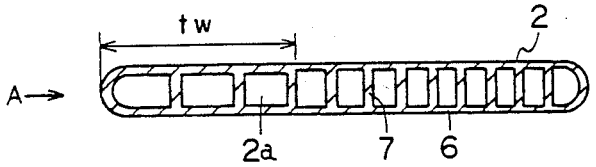
FIG. 5 shows a transverse cross-sectional view of a flat tube of a second embodiment of the present invention.
Figure 6:
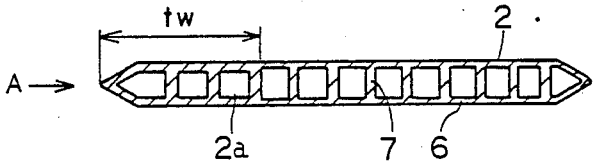
FIG. 6 shows a transverse cross-sectional view of a flat tube of a third embodiment of the present invention, and FIGS. 7, 8 and 9 respectively show transverse cross-sectional views of the flat tubes of the fourth, fifth and sixth embodiments of the present invention.
Figure 7:
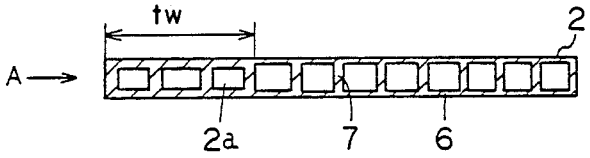

As is shown in FIG. 5, it is possible to make the longitudinal passages 2*a* larger in width in the air inlet end portion than those in the remaining portion. It is also possible to make the longitudinal passageways larger in width the remaining portion. The edges 26 of the flat tube 2 can be made triangularly apexed as is shown in FIG. 6 or flat as is shown in FIG. 7.

Figure 8:
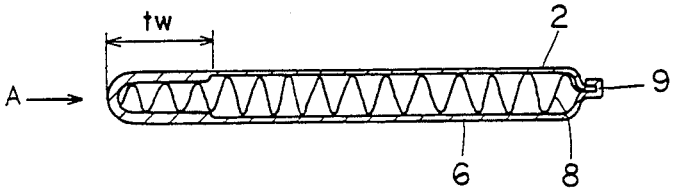
Figure 9:
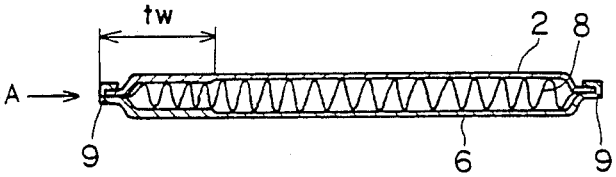

In the embodiments above explained, the flat tube 2 is made by extrusion. However it can be made from sheet metal as is shown in FIGS. 8 and 9. In those Figures, numeral 8 designates an inner fin which is brazed to the flat tube 2 made from sheet metal. The ends 9 are also secured together by brazing.

In the embodiments above, the present invention is applied to evaporators. However it is also possible to apply the same to condensers and other heat exchangers. When the condensers are made with the present invention, it is preferable to use pure aluminum for the flat tube.

What we claim is:

1. In a heat exchanger flat tube for use in a cross-flow indirect heat exchanger:

(a) in which a corrosive vapor to be cooled is passed externally, transversally of the flat tube, while a fluid capable of absorbing heat conducted through an outer peripheral sidewall of the tube extending perimetrically of the tube is circulated longitudinally of the tube through longitudinal passageway means of the tube, (b) in which the tube is made of a metal having a relatively high heat conductivity, but one which is, over time, capable of being corrosively attacked by said vapor to such a degree as to eventually produce pinholes through said outer peripheral wall, at least at vapor inlet conditions to the heat exchanger, (c) in which said outer peripheral wall of the tube is constructed and arranged to have two opposite relatively broad faces and two opposite narrow edges, and (d) in which said tube is constructed and arranged to have one of said narrow edges be a leading edge thereof as respects said vapor inlet, the improvement wherein:

said outer peripheral wall of said tube is substantially thicker over a portion thereof which includes all of said leading edge and respective adjoining parts of said opposite faces, than it is over the remainder thereof.

2. The improved heat exchanger flat tube of claim 1, wherein:

said longitudinal passageway means is divided internally of said tube by longitudinally extending wall means into a single, transversally extending series of a plurality of side-by-side longitudinal passageways.

3. The improved heat exchanger flat tube of claim 2, wherein:

said wall means are integrally formed with said outer peripheral wall.

4. The improved heat exchanger flat tube of claim 2, wherein:

said tube is transversally corrugated about axis at least generally parallel to said broad faces, so as to have two oppositely opening, longitudinally extending series of troughs defined externally thereon; and fin means externally secured on each broad face of said tube in each said trough, such fin means being constructed and arranged to divide said trough into a plurality of vapor flow passageways defining at opposite ends thereof said vapor inlet and a vapor outlet.

5. The improved heat exchanger flat tube of claim 4, wherein:

said tube is made of an aluminum alloy;

said broad faces are each about 100 mm to about 200 mm broad;

said tube has a thickness from one said broad face to the other of about 3 mm to about 10 mm;

said outer peripheral wall of said tube has a thickness of 0.3 mm to 1.5 mm in said thicker portion thereof, and a thickness of 0.2 mm to 1.0 mm in said remainder thereof; and said thicker portion extends throughout less than half the breadth of each said broad face thereof.

6. The improved heat exchanger flat tube of claim 5, wherein:

said thickened portion extends throughout at least 5 mm of the breadth of each said broad face.

7. The improved heat exchanger flat tube of claim 5, wherein:

said outer peripheral wall of said tube is thickened on said thicker portion substantially entirely by being internally thickened, with external thickness of said tube remaining substantially constant across said tube corresponding both to where said thickened portion and remainder of said outer peripheral wall are located.

8. The improved heat exchanger flat tube of claim 7, wherein:

said wall means are spaced further apart where they extend between corresponding sites on said thickened portion of said outer peripheral wall than where they extend between corresponding sites on said remainder of said outer peripheral wall, by amounts such as to provide all said longitudinal passageways with at least approximately equal transverse cross-sectional areas.

9. The improved heat exchanger flat tube of claim 2, wherein:

said outer peripheral wall of said tube is thickened in said thicker portion substantially entirely by being internally thickened, with external thickness of said tube remaining substantially constant across said tube corresponding both to where said thickened portion and remainder of said outer peripheral wall are located.

10. The improved heat exchanger flat tube of claim 9, wherein:

said wall means are spaced further apart where they extend between corresponding sites on said thickened portion of said outer peripheral wall than where they extend between corresponding sites on said remainder of said outer peripheral wall, by amounts such as to provide all said longitudinal passageways with at least approximately equal transverse cross-sectional areas.

11. In a cross-flow indirect heat exchanger including at least one flat tube constructed and arranged to have a corrosive vapor to be cooled passed externally, transversally of the tube, while a fluid capable of absorbing heat conducted through an outer peripheral sidewall extending perimetrically of the flat tube is circulated longitudinally of the tube through longitudinal passageway means of the tube, the tube being made of a metal having a relatively high heat conductivity but being capable, over time, of being corrosively attacked by said vapor to such a degree as to eventually produce pinholes through said outer peripheral wall, at least at vapor inlet conditions to the heat exchanger, said heat exchanger being so constructed and arranged that said tube has two opposite relatively broad faces and two opposite narrow edges with one of said narrow edges being presented as a leading edge as respects said vapor inlet, the improvement wherein:

said outer peripheral wall of said tube is substantially thicker over a portion thereof which includes all of said leading edge and respective adjoining parts of said opposite faces, than it is over the remainder thereof.

12. The improved heat exchanger of claim 11, wherein:

said longitudinal passageway means is divided internally of said tube by longitudinally extending wall means into a single, transversally extending series of a plurality of side-by-side longitudinal passageways.

13. The improved heat exchanger of claim 12, further including:

said longitudinal passageways opening at opposite ends of said tube respectively into a cooling fluid inlet manifold and a cooling fluid outlet manifold secured with said tube.

14. The improved heat exchanger of claim 13, wherein:

said tube is transversally corrugated about axis at least generally parallel to said broad faces, so as to have two oppositely opening, longitudinally extending series of troughs defined externally thereon; and fin means externally secured on each broad face of said tube in each said trough, such fin means being constructed and arranged to divide said trough into a plurality of vapor flow passageways defining at opposite ends thereof said vapor inlet and a vapor outlet.

15. The improved heat exchanger of claim 14, wherein:

said tube is made of an aluminum alloy;

said broad faces are each about 100 mm to about 200 mm broad;

said tube has a thickness from one said broad face to the other of about 3 mm to about 10 mm;

said outer peripheral wall of said tube has a thickness of 0.3 mm to 1.5 mm in said thicker portion thereof, and a thickness of 0.2 mm to 1.0 mm in said remainder thereof; and said thicker portion extends throughout less than half the breadth of each said broad face thereof.

16. The improved heat exchanger of claim 15, wherein:

said thickened portion extends throughout at least 5 mm of the breadth of each said broad face.

17. The improved heat exchanger of claim 15, wherein:

said outer peripheral wall of said tube is thickened on said thicker portion substantially entirely by being internally thickened, with external thickness of said tube remaining substantially constant across said tube corresponding both to where said thickened portion and remainder of said outer peripheral wall are located.

18. The improved heat exchanger of claim 17, wherein:

said wall means are spaced further apart where they extend between corresponding sites on said thickened portion of said outer peripheral wall than where they extend between corresponding sites on said remainder of said outer peripheral wall, by amounts such as to provide all said longitudinal passageways with at least approximately equal transverse cross-sectional areas.

19. The improved heat exchanger of claim 12, wherein:

said outer peripheral wall of said tube is thickened on said thicker portion substantially entirely by being internally thickened, with external thickness of said tube remaining substantially constant across said tube corresponding both to where said thickened portion and remainder of said outer peripheral wall are located.

20. The improved heat exchanger of claim 19, wherein:

said wall means are spaced further apart where they extend between corresponding sites on said thickened portion of said outer peripheral wall than where they extend between corresponding sites on said remainder of said outer peripheral wall, by amounts such as to provide all said longitudinal passageways with at least approximately equal transverse cross-sectional areas.

* * * * *